United States Patent [19]

Scott et al.

[11] Patent Number: 4,520,772

[45] Date of Patent: Jun. 4, 1985

[54] FUEL SHUT-OFF VALVE FOR INTERNAL COMBUSTION ENGINES

[75] Inventors: William A. Scott, Cass City; Roger N. Smith, Caro, both of Mich.

[73] Assignee: Walbro Corporation, Cass City, Mich.

[21] Appl. No.: 585,494

[22] Filed: Mar. 2, 1984

[51] Int. Cl.[3] ..... F02B 77/08

[52] U.S. Cl. ..... 123/198 DB

[58] Field of Search ..... 123/198 DB, 198 D

[56] References Cited

U.S. PATENT DOCUMENTS

| | | | |
|---|---|---|---|
| 3,148,671 | 9/1964 | Bottorff et al. | 123/198 DB |
| 3,246,641 | 4/1966 | Goehring | 123/198 DB |
| 3,913,551 | 10/1975 | Shaver | 123/198 DB |
| 4,054,116 | 10/1977 | Goddington | 123/198 DB |
| 4,080,946 | 3/1978 | Cunningham | 123/198 DB |
| 4,137,889 | 2/1979 | Nigra | 123/198 DB |

*Primary Examiner*—Ira S. Lazarus

*Attorney, Agent, or Firm*—Barnes, Kisselle, Raisch, Choate, Whittemore & Hulbert

[57] ABSTRACT

An automatic fuel shut-off valve for the fuel line of an internal combustion engine which is responsive to crankcase pressure to open and supply fuel to the engine carburetor when the engine is operating. Pressure in the fuel tank cannot open the valve and thus the shut-off valve provides a safety device especially useful in household equipment.

1 Claim, 2 Drawing Figures

FUEL SHUT-OFF VALVE FOR INTERNAL COMBUSTION ENGINES

FIELD OF INVENTION

Carburetion systems for internal combustion engines and fuel shut-off valves responsive to engine functioning.

BACKGROUND OF INVENTION

Small engines find many uses in the average household. They are used, for example, in lawn mowers, snowblowers, chain saws, weed cutters and small power generators. It is desirable that the fuel supply from the fuel tank be cut off from the engine when the engine is not in use. This prevents a fuel build-up in the carburetor and possible leakage of inflammable fuel into a garage or basement where the particular appliance is stored. Since liquid fuel expands with heat, any storage in an area which may become warm due to ambient conditions may cause fuel to be forced into the carburetor and cause leakage. A manual fuel shut-off valve may be used but human frailty or lack of knowledge may result in this not being properly operated.

Accordingly, it is the object of the present invention to provide a fuel shut-off valve which closes automatically when an engine is shut off. A further object is a shut-off valve which opens automatically when an engine is turned over in the starting or in operation after starting.

Other objects and features of the invention will be apparent in the following description and claims in which the invention is described together with the disclosure of an embodiment directed to those skilled in the art to enable practice of the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
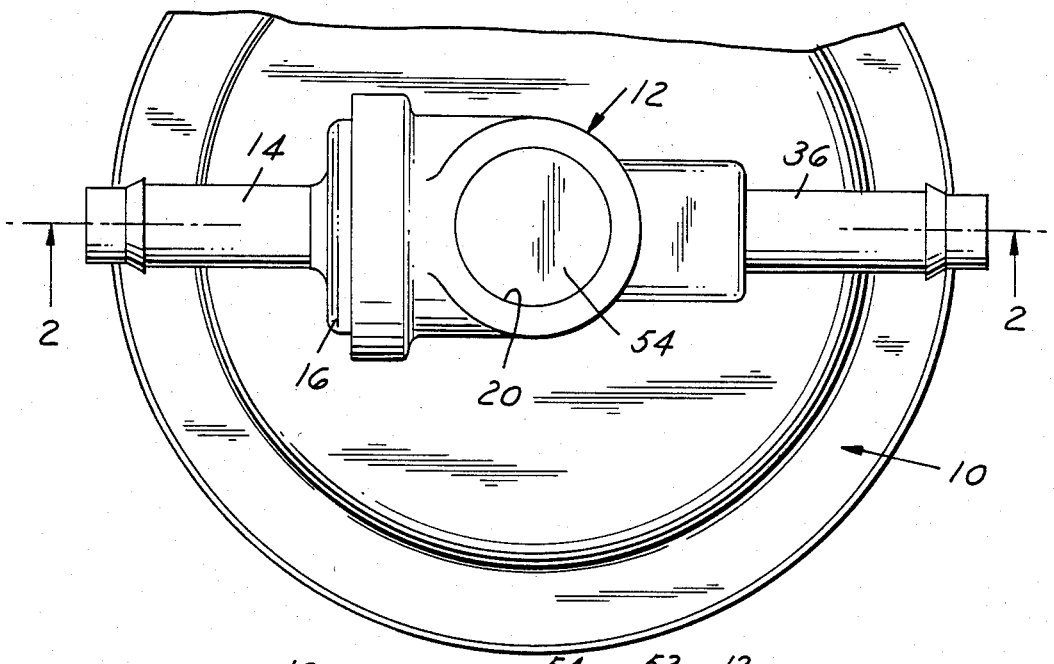
FIG. 1, a top view of the housing of the shut-off valve.
Figure 2:
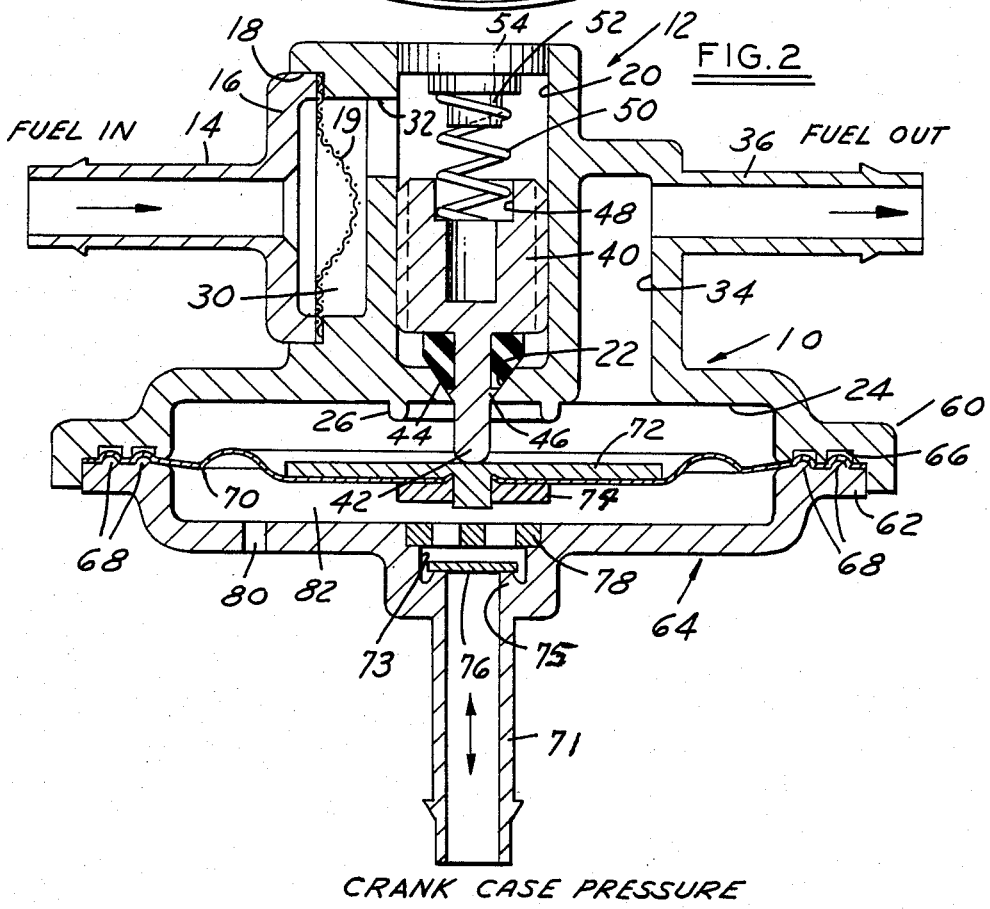
FIG. 2, a vertical sectional view showing the various elements of the shut-off valve.

WITH REFERENCE TO THE DRAWINGS, in FIG. 1, a top view of the valve housing is illustrated, showing a top housing element 10 with an integral crown portion 12. A fuel inlet connector 14 has a flared flange 16 which is press-fitted into a recess 18 in a sealing relationship. A filter screen 19 (FIG. 2) is secured in the inlet line by the flange 16.

The crown portion 12 has a vertical bore 20 which terminates at the lower end in a tapered valve seat 22 leading to a top diaphragm chamber 24. An annular lip 26 provides a stop for the diaphragm. An inlet chamber 30 inside the flange 16 opens to the bore 20 through a port 32 on one side of the bore. At the other side of the bore is a riser passage 34 open to a fuel outlet connector 36 on axis with the inlet connector 14. Thus, the device can be connected in-line in a fuel line.

Within the bore 20 is a valve piston 40 having a ribbed outer surface to allow passage of fuel past the valve in bore 20. A central projection stem 42 on the valve piston carries a plastic neoprene or elastomer valve tip 44 which is retained on the projection by a small annular retainer lip 46. This valve tip is tapered to cooperate with seat 22 and may be made of Viton (Trademark).

The top of the valve piston 40 has a recess 48 to receive one end of a biasing coil spring 50 seated at the other end on a central projection 52 on a plug 54 which can be sonic welded in place at the top of bore 20.

The top housing 12 has an outwardly extending downturned flange 60 which receives the outer flange 62 of a bottom housing 64 in a sealed relationship. Annular grooves 66 on the flange 60 and annular ribs 68 on the flange 62 grip and seal the periphery of a diaphragm 70. A central upper plate 72 carried by the diaphragm is clamped to the diaphragm by a disc 74 fastened on to a downwardly projecting pin by sonic welding or other suitable means.

The lower housing 64 has a downwardly projecting connector tube 71 which opens to a chamber 73 in which is formed an annular valve seat 75 to cooperate with a disc valve 76 captured by a perforate insert 78. An atmospheric opening 80 vents the chamber 82 below the diaphgram 70.

The described device serves as an automatic fuel shut-off valve in a fuel supply system for an internal combustion engine. When valve 44 is closed, no fuel can reach the outlet tube connector 36. Fuel pressure developing in a fuel tank due to ambient heat, for example, will act to close the valve 44 and prevent leakage into the engine connected to outlet 36.

When an engine is cranked or operating, pulses from the crankcase will act through connector 71 on the diaphragm 70 to urge the diaphragm upwardly against the stem 42 to open valve 44. The positive pulses from the engine are stronger than the negative pulses to achieve this result. This result is enhanced by the check valve 76 which effectively blocks out the negative pulses. Thus, fuel can flow past the valve piston 40 and valve 44 to riser passage 34 and outlet 36.

If a fuel pump is used with the engine carburetion system, the suction of the pump will actuate the diaphragm and eliminate the need for the crankcase connection.

What is claimed is:

1. An automatic fuel shut-off valve for use in a fuel line below a fuel tank in a fuel supply system for an internal combustion engine which comprises:

(a) a housing shell having a fuel inlet passage and a fuel outlet passage in line on a coincident first axis, an inlet chamber and an outlet chamber in said housing on opposite sides of a central axis normal to said first axis, each communicating respectively with the said inlet and outlet passages, a central cylinder formed between said chambers on said central axis open at one end to said inlet chamber and having a valve seat at the other end open to said outlet chamber, (b) a slide valve in said cylinder having an open and closed position and shaped to allow flow around its periphery from said inlet chamber to said outlet chamber, and a valve end formed on said slide valve to close said seat in the closed position of said valve, said slide valve having a projection extending below said seat into a diaphragm chamber formed in said housing, (c) means to bias said valve to a closed position, (d) a diaphragm in said diaphragm chamber positioned to act on said projection to open said valve against said biasing means to allow fuel to flow from said inlet to said outlet, (e) a connection in said housing for introducing crankcase pressure of an internal combustion to one side of said diaphragm, and (f) a unidirectional valve in said connection so that only positive pressure pulses reach said diaphragm to open said valve when an engine is running.

* * * * *